US010151478B2

(12) United States Patent
Park et al.

(10) Patent No.: US 10,151,478 B2
(45) Date of Patent: Dec. 11, 2018

(54) BURNER PROVIDED WITH FLAME HOLE MEMBER HAVING AIR HOLES

(71) Applicants: Kyungdong Navien Co., Ltd., Pyeongtaek, Gyeonggi-do (KR); ALANTUM CO., LTD., Seongnam, Gyeonggi-do (KR)

(72) Inventors: June Kyu Park, Incheon (KR); Gi Young Kim, Gyeonggi-do (KR)

(73) Assignee: Kyungdong Navien Co., Ltd., Pyeongtaek, Gyeonggi-do (KR)

( * ) Notice: Subject to any disclaimer, the term of this patent is extended or adjusted under 35 U.S.C. 154(b) by 143 days.

(21) Appl. No.: 15/245,627

(22) Filed: Aug. 24, 2016

(65) Prior Publication Data

US 2016/0363316 A1 Dec. 15, 2016

Related U.S. Application Data

(63) Continuation of application No. PCT/KR2015/001748, filed on Feb. 24, 2015.

(30) Foreign Application Priority Data

Feb. 25, 2014 (KR) ..... 10-2014-0021974

(51) Int. Cl.
*F23D 14/02* (2006.01)
*F23D 14/58* (2006.01)
(Continued)

(52) U.S. Cl.
CPC ..... *F23D 14/02* (2013.01); *F23D 14/14* (2013.01); *F23D 14/58* (2013.01); *F23D 14/70* (2013.01);
(Continued)

(58) Field of Classification Search
CPC ..... F23D 2203/102
(Continued)

(56) References Cited

U.S. PATENT DOCUMENTS 3,251,396 A 5/1966 Nitsche
3,724,994 A * 4/1973 Desty ..... F23D 14/20 431/328
(Continued)

FOREIGN PATENT DOCUMENTS

EP 0751344 A1 1/1997
EP 0915293 A2 5/1999
(Continued)

*Primary Examiner* — Avinash Savani
(74) *Attorney, Agent, or Firm* — Mintz Levin Cohn Ferris Glovsky and Popeo, P.C.; Kongsik Kim; Jhongwoo Jay Peck

(57) ABSTRACT

An object of the present disclosure is to provide a pre-mixed burner capable of preventing a backfire, improving flame stability, and responding to various combustion loads. To attain the object, the present disclosure is implemented by including a flame hole member made of a foam body which is made from a plurality of metal alloys through a sintering process and in which an air hole being a space between struts configuring a framework is formed, and configured to form a flame by allowing a mixed gas of gas and air to be sprayed through the air hole, a flame hole member fixing plate configured to fixedly couple the flame hole member to a burner main body, and a distributing plate provided in front of the flame hole member and at which a plurality of distributing holes are formed so as to uniformly supply the mixed gas to the flame hole member.

14 Claims, 11 Drawing Sheets

(51) Int. Cl.
*F23D 14/70* (2006.01)
*F23D 14/82* (2006.01)
*F23D 14/14* (2006.01)

(52) U.S. Cl.
CPC ..... *F23D 14/82* (2013.01); *F23D 2203/102* (2013.01); *F23D 2203/106* (2013.01); *F23D 2203/1017* (2013.01); *F23D 2203/1055* (2013.01); *F23D 2212/20* (2013.01)

(58) Field of Classification Search
USPC ..... 431/328, 326
See application file for complete search history.

(56) References Cited

U.S. PATENT DOCUMENTS 5,088,919 A * 2/1992 De Bruyne ..... F23D 14/16 126/92 AC
5,439,372 A * 8/1995 Duret ..... F23D 14/02 431/2
5,511,974 A * 4/1996 Gordon ..... F23D 14/02 431/328
5,520,536 A 5/1996 Rodgers et al.
2008/0227044 A1 9/2008 Cookson et al.
2012/0244483 A1* 9/2012 Min ..... F23D 14/586 431/354
2013/0232745 A1 9/2013 Dreizler et al.

FOREIGN PATENT DOCUMENTS

JP S51-131736 U 10/1976
JP S59-225210 A 12/1984
JP H03-110312 A 5/1991
JP 10-185126 A 7/1998
JP H10-267232 A 10/1998
JP 2000-130715 A 5/2000
JP 4600991 B2 12/2010
KR 10-2009-0032686 A 4/2009
KR 10-2009-0078581 A 7/2009
WO 03062705 A1 7/2003

* cited by examiner

BURNER PROVIDED WITH FLAME HOLE MEMBER HAVING AIR HOLES

CROSS-REFERENCE TO RELATED APPLICATIONS

This is a continuation of International Application No. PCT/KR2015/001748 filed on Feb. 24, 2015, which claims priority to Korean Application No. 10-2014-0021974 filed on Feb. 25, 2014, which applications are incorporated herein by reference.

TECHNICAL FIELD

The present disclosure relates to a burner provided with flame hole member having air holes, and more particularly, to a burner including a flame hole member made of an alloy foam that is formed by applying alloy powder on a metal foam to sinter it, to thereby be able to improve a turndown ratio and also to prevent backfire generation.

RELATED ART

Generally, a gas boiler, which is used in a combustion device including a boiler, a water heater, and the like, may be classified into a Bunsen burner and a pre-mixed burner according to a method of mixing combustion gas with air.

The Bunsen burner is a burner for realizing a complete combustion by supplying a minimum amount of primary air, which is required for combustion, through a nozzle portion spraying gas, and then supplying excessive secondary air to a region at which a flame is formed, and has advantages including flame stability of a burner and low generation possibility of a backfire phenomenon and the like, whereas, because a length of the flame is long and a flame temperature is high due to the fact that the flame is formed by the secondary air and also an amount of air required for a combustion is excessively needed more than a theoretical amount of air, heat loss due to a discharge of an exhaust gas of a high temperature and an exhaust amount of pollutants are large so that the Bunsen burner has a disadvantage of somewhat limitation regarding an efficiency maximization, a pollutant reduction and the like of a gas combustion device.

Meanwhile, the pre-mixed burner employs a method of burning premixed gas that is premixed of combustion gas and air in a mixing chamber, and is able to reduce an overall length of a flame and, at the same time, to lower a flame temperature to thereby reduce a load with respect to the same area so that the pre-mixed burner has an advantage capable of reducing generation of pollutants including a carbon monoxide, a nitrogen oxide and the like to the least extent.

The Bunsen burner was mainly used in the past, but recently, the pre-mixed burner is mainly used for reducing generation of pollutants and miniaturizing a combustion chamber.

A conventional pre-mixed type gas burner is configured with a structure in which air flowing in through an air suction inlet and gas flowing in through a gas suction inlet are mixed with each other in a suction pipe when a ventilator operates, and then they are premixed in a premixing chamber after passing the ventilator to be supplied to a burner port portion that is provided at an upper side of the burner.

A burner port plate is provided at the burner port portion, and a stainless punched plate, a metal fiber, a ceramic and the like are used in the burner port plate.

The burner port plate made of the stainless punched plate is used in a structure in which burner ports are punched in a single plate material, but it has disadvantages in that noise is considerably generated and a combustion load range is narrowed because a burner combustion surface is deformed or, in the worst case, the burner port is damaged due to thermal stress to thereby cause an incomplete combustion and a backfire. Also, the stainless punched plate is made to have a burner port shape by a press die so that there are problems in that the burner port shape is unsophisticated and is difficult to have a stereoscopic shape.

To compensate these disadvantages, a burner port structure using a material, which includes a metal fiber made by weaving metal fibers, a ceramic plate manufactured by sintering a ceramic, and the like, has been used, but it has a disadvantage in that a manufacture cost is increased because a material cost is unfavorably high and a manufacturing method is inconvenient.

Meanwhile, "Open-Porous Metal Foam and Method for manufacturing the same" is disclosed in Korean Registered Patent No. 1212786, and the open-porous metal foam is a semi-product which is formed of iron or an iron-based alloy that does not contain chrome and aluminum or contains an amount of chrome and aluminum smaller than that of those contained in a powder of an iron-chrome-aluminum alloy, and is manufactured through a process of uniformly coating a surface and an open-pore of the semi-product, which is formed of the iron or the iron-based alloy, with the powder of the iron-chrome-aluminum alloy and an organic binding agent, performing a heat treatment on the semi-product, which is formed of the iron or the iron-based alloy, at a temperature in a range of 300° C. to 600° C. under a reduction atmosphere to discharge organic components, and then sintering the semi-product, which is formed of the iron or the iron-based alloy and from which the organic components are discharged, at a temperature over 900° C.

The open-porous metal foam manufactured by such a method may be catalytically activated for the purpose of a chemical process, may be used in an environmental engineering and the like, or may be used for the purpose of filtration, and particularly, may be used under a circumstance of high temperature.

SUMMARY

An object of the present disclosure is to provide a burner capable of preventing a backfire, increasing flame stability, and responding to various combustion loads using an open-porous metal foam in the burner.

To attain the above described object, a burner of the present disclosure includes a flame hole member made of a foam body which is made from a plurality of metal alloys through a sintering process and in which an air hole being a space between struts configuring a framework is formed, and configured to form a flame by allowing mixed gas of gas and air to be sprayed through the air hole, a flame hole member fixing plate configured to fixedly couple the flame hole member to a burner main body, and a distributing plate provided in front of the flame hole member and at which a plurality of distributing holes are formed so as to uniformly supply the mixed gas to the flame hole member.

The air hole may be configured with multiple cells and multiple pores, each of the multiple cells being an inner space surrounded by the struts and each of the multiple pores being a space in which the cell is connected to a cell adjacent thereto, and an average size of the multiple cells being formed per unit volume of the flame hole member may be equal to or less than 1200 μm.

A size of the cell may be defined by the following Equation, $$D=\sqrt{ab} \quad \text{[Equation]}$$

wherein D may represent the size of the cell, a may represent a major axis length of the cell, and b may represent a minor axis length thereof.

An occupying ratio of the air hole per unit volume of the flame hole member may be equal to or greater than 80%.

A plurality of compressed portions may be concavely pressed and compressed to be formed at a surface of the flame hole member and to be spaced apart from each other at a regular interval.

A through hole may be formed inside each of the plurality of compressed portions to pass through in a thickness direction of the flame hole member.

A through hole may be formed between the plurality of compressed portions to pass through in a thickness direction thereof.

The compressed portion may be configured with multiple first compressed portions spaced apart from each other at a regular interval, and each of multiple second compressed portions formed between the multiple first compressed portions to have a size smaller than that of each of the multiple first compressed portions.

A plurality of through holes may be formed at the flame hole member to pass therethrough in a thickness direction thereof and to be spaced apart from each other at a regular interval.

The distributing plate may be coupled to the flame hole member fixing plate via the flame hole member interposed between the distributing plate and the flame hole member fixing plate.

A protrusion may be formed at the distributing plate to be come into contact with a rear surface of the flame hole member, thereby separating the distributing plate from the rear surface of the flame hole member.

The protrusion may be formed at an outer circumference of a region at which the plurality of distributing holes are formed.

A gap plate configured to separate the distributing plate from the flame hole member may be further included, wherein the gap plate may be formed to surround a region at which the distributing holes are formed.

The plurality of metal alloys may include nickel (Ni), chrome (Cr), and aluminum (Al).

According to the burner of the present disclosure, the burner is provided with the flame hole member made of the metal foam having the air holes, thereby being able to increase flame stability, prevent backfire generation, and respond to various combustion loads by improving a turndown ratio.

BRIEF DESCRIPTION OF THE DRAWINGS

The above and other objects, features and advantages of the present disclosure will become more apparent to those skilled in the art by describing in detail exemplary embodiments thereof with reference to the accompanying drawings, in which.

DETAILED DESCRIPTION

Hereinafter, the configuration and action with respect to a preferred embodiment of the present disclosure will be described in detail with reference to the accompanying drawings as follows.

Figure 1:
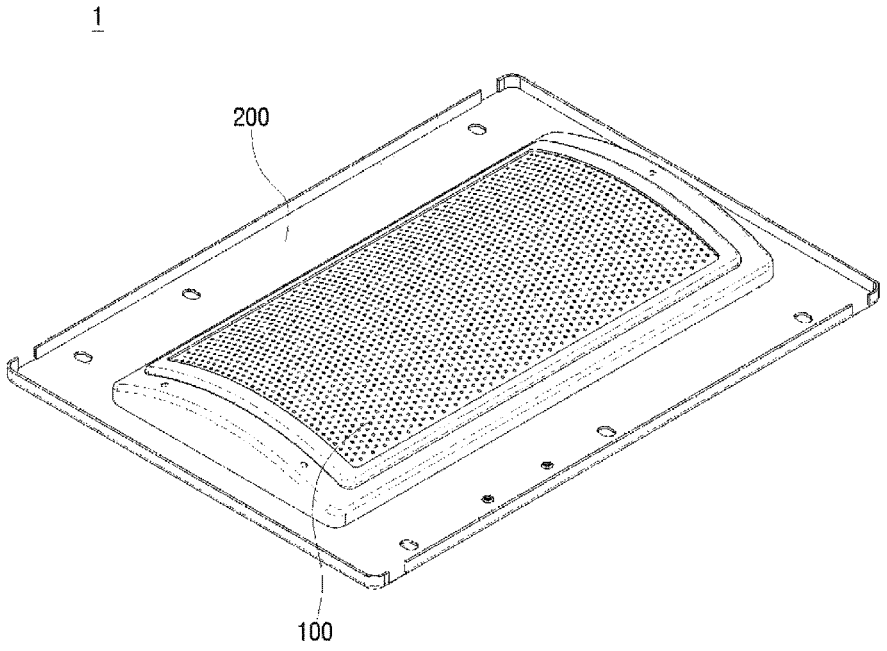
FIG. 1 is a perspective view illustrating a state in which a flame hole member, a flame hole member fixing plate, and a distributing plate are coupled to each other in a burner of the present disclosure.
Figure 2:
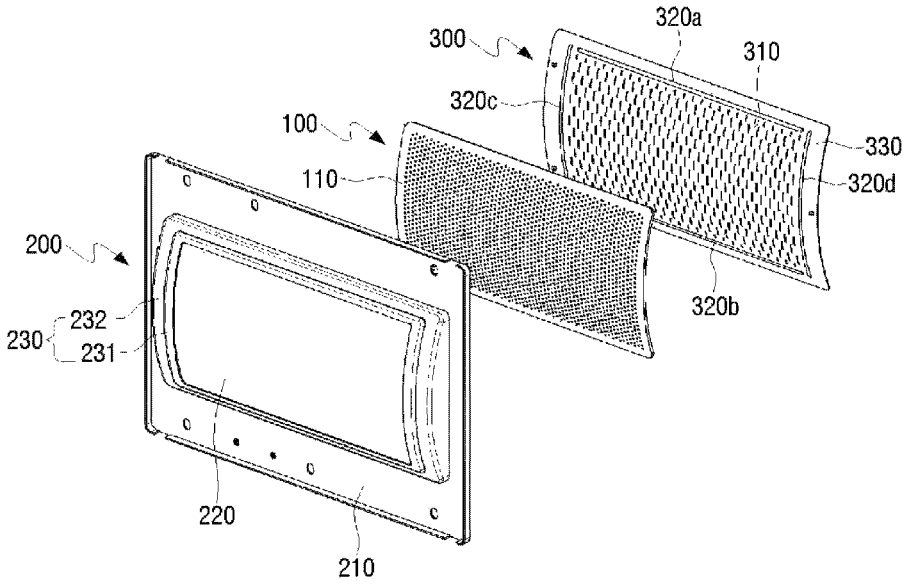
FIG. 2 is a perspective view illustrating a state in which components of the burner shown in FIG. 1 are decoupled from each other.
Figure 3:
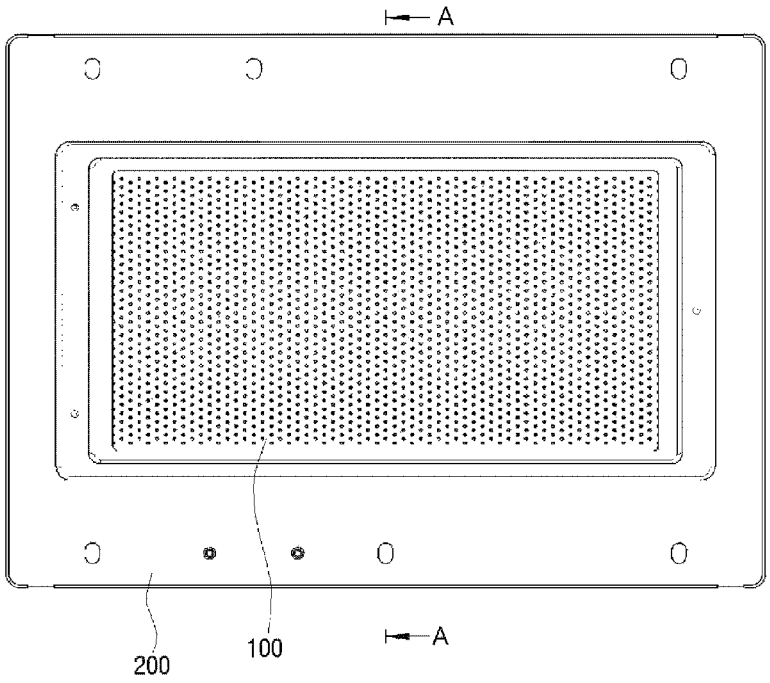
FIG. 3 is a plan view of the burner shown in FIG. 1.
Figure 4:
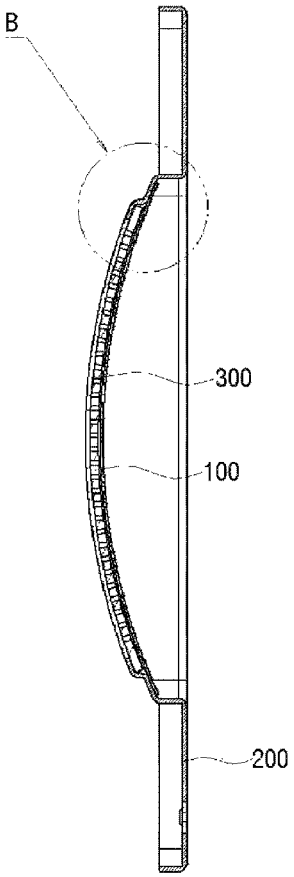
FIG. 4 is a cross-sectional view taken along line A-A of FIG. 3.
Figure 5:
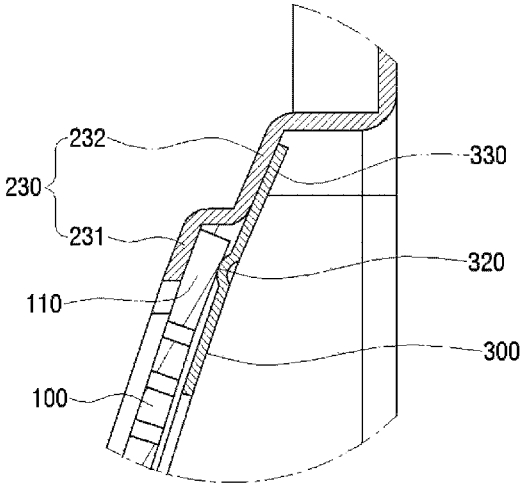
FIG. 5 is a diagram enlarging a portion B of FIG. 4.

FIG. 1 is a perspective view illustrating a state in which a flame hole member, a flame hole member fixing plate, and a distributing plate are coupled to each other in a burner of the present disclosure, FIG. 2 is a perspective view illustrating a state in which components of the burner shown in FIG. 1 are decoupled from each other, FIG. 3 is a plan view of the burner shown in FIG. 1, FIG. 4 is a cross-sectional view taken along line A-A of FIG. 3, and FIG. 5 is a diagram enlarging a portion B of FIG. 4.

Hereinafter, based on a position of a flame hole member 100, a "front" means a position before mixed gas passes through the flame hole member 100, whereas a "rear" means a position after the mixed gas passed therethrough.

A burner 1 of the present disclosure is configured with a flame hole member 100 in which mixed gas is sprayed through an air hole formed thereinside to form a flame, a flame hole member fixing plate 200 for fixedly coupling the flame hole member 100 to a burner main body (not shown), and a distributing plate 300 provided in front of the flame hole member 100 to uniformly supply the mixed gas to the flame hole member 100.

The flame hole member fixing plate 200 is configured with a body portion 210 formed in a flat plate shape and coupled to the burner main body by a coupling means (not shown), an opening portion 220 formed by which a central portion of the body portion 210 is opened, and a coupling portion 230 formed by which an inward edge portion of the body portion 210 surrounding peripheries of the opening portion 220 protrudes in a rear direction and coupled to the flame hole member 100.

The coupling portion 230 is configured with a flame hole member coupling portion 231 formed in a quadrangular frame shape so as to surround the peripheries of the opening portion 220, and a distributing plate coupling portion 232 formed in a quadrangular frame shape so as to surround an outward side of the flame hole member coupling portion 231 and formed to be stepped therefrom.

In a state in which an edge 110 of one side surface of the flame hole member 100 is located to come into contact with an inward surface of the flame hole member coupling portion 231 and an edge 330 of one side surface of the distributing plate 300 is located to come into contact with an inward surface of the distributing plate coupling portion 232, when the edge 330 of the distributing plate 300 is coupled to the inward surface of the distributing plate coupling portion 232, the flame hole member 100, the distributing plate 300, and the flame hole member fixing plate 200 are integrally coupled to each other.

A plurality of distributing holes 310 are formed at the distributing plate 300 to be spaced apart from each other at a regular interval so as to uniformly supply mixed gas of air and gas, which is supplied from a ventilator (not shown), to an entire area of the flame hole member 100.

Each of the distributing holes 310 may be preferably formed in a slit shape, but is not limited thereto, and any shape capable of uniformly supplying the mixed gas may be applicable without such limitation.

A protrusion 320, which protrudes in a front direction so as to come into contact with a rear surface of the flame hole member 100 to thereby separate between the rear surface thereof and the distributing plate 300, is formed at the distributing plate 300 between a region at which the distributing holes 310 are formed and the edge 330.

The protrusion 320 is configured with a first protrusion 320*a* and a second protrusion 320*b*, which are horizontally formed at upper and lower sides of the distributing plate 300, respectively, in a long band shape, and a third protrusion 320*c* and a fourth protrusion 320*d*, which are vertically formed at left and right sides of the distributing plate 300, respectively, in a long band shape, so as to surround the region at which the distributing holes 310 are formed from an outside.

With such a configuration, because a front surface of the distributing plate 300 and the rear surface of the flame hole member 100 are spaced apart from each other by a constant distance, the mixed gas passing through the distributing holes 310 of the distributing plate 300 may be uniformly supplied to the flame hole member 100, and delivering high temperature heat from the flame hole member 100 to the distributing plate 300 upon combustion may be blocked, thereby preventing the distributing plate 300 from being overheated.

Also, the protrusion 320 formed in the long band shape is configured to surround the region at which the distributing holes 310 are formed so that it may be prevented that the mixed gas sprayed through the distributing holes 310 disperses to the outside of the region at which the distributing holes 310 are formed.

A plurality of air holes are formed at the flame hole member 100 by forming a plurality of metal alloys into a foaming body through a sintering process, and the mixed gas of gas and air is sprayed through the air holes to form a flame.

Hereinafter, the flame hole member 100 of the present disclosure will be described in detail with reference to FIGS. 6 and 7.

Figure 6:
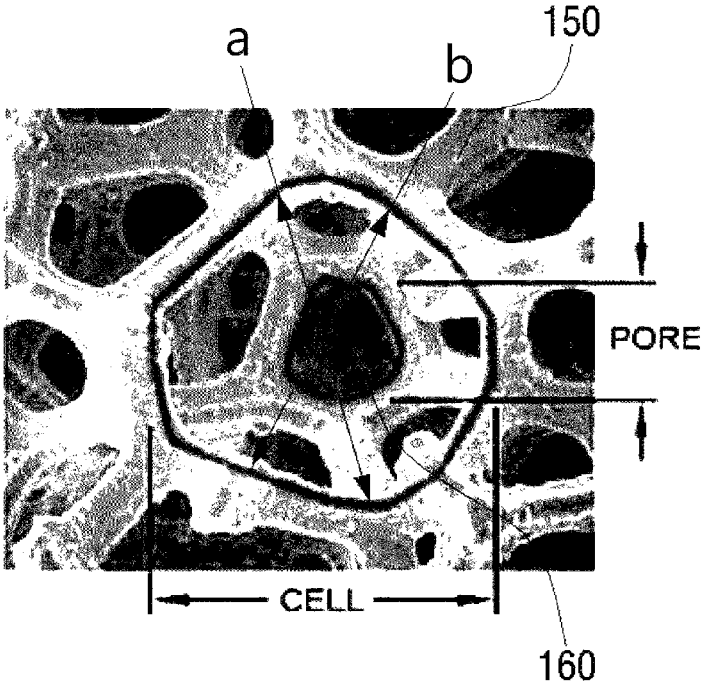
FIG. 6 is a diagram enlarging an inner side of a flame hole member according to the present disclosure.
Figure 7:
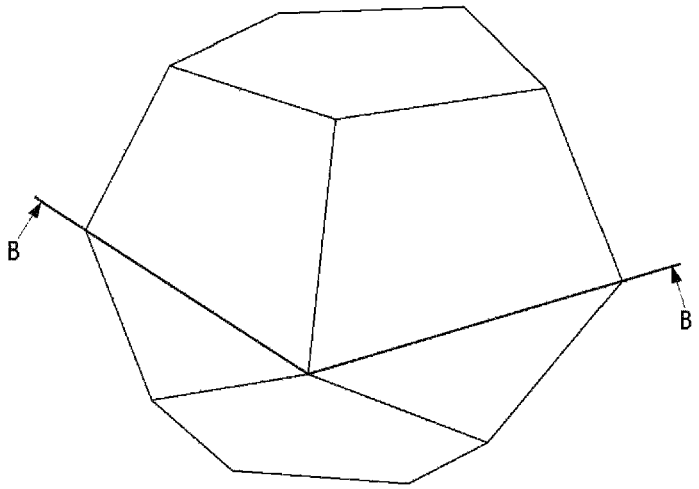
FIG. 7 is a diagram modeling a cell shape of the flame hole member according to the present disclosure.

FIG. 6 is a diagram enlarging an inner side of a flame hole member according to the present disclosure, and FIG. 7 is a diagram modeling a cell shape of the flame hole member according to the present disclosure.

As disclosed in Korean Registered Patent No. 1212786, the flame hole member 100 is manufactured using a plurality of metal alloy powders through a sintering process.

The metal alloy may be an iron-based alloy containing chrome (Cr) and aluminum (Al). The chrome is contained in the iron-based alloy to improve corrosion resistance and high temperature oxidation resistance, and the aluminum (Al) enables an aluminum oxide and the like to be formed on a surface of the iron-based alloy under a circumstance being exposed to high temperature.

Also, the metal alloy may be a nickel-based alloy containing chrome (Cr) and aluminum (Al). When a turndown ratio (TDR) meaning a combustion load range of a burner is improved, combustion takes place on a surface of the burner when a load is low. In other words, because a spraying speed of the mixed gas is low when a load is low, a flame is formed in the vicinity of a surface of the flame hole member 100 and thus red heat is generated on the surface thereof to degrade durability of the burner, whereas, if the nickel-based alloy is employed as described above, the durability may be improved at high temperature.

The flame hole member 100 of the present disclosure is referred to as a metal foam. The metal foam means an open-cell structure, that is, a structure in which cells and pores constituting an air hole 160 are spatially connected to each other.

As shown in FIG. 6, the flame hole member 100 includes struts 150 which configure a framework of the metal foam and are three-dimensionally intertwined with each other as like as a mesh, and, if an inner space surrounded by the struts 150 is defined as a cell and a space connected to the cell is defined as a pore, the air hole 160 is configured with the cells and the pores.

The mixed gas passes through the air hole 160 and is sprayed therethrough formed on the surface of the flame hole member 100 so that a flame is formed.

When the flame hole member 100 is formed in a structure in which the air holes 160 are connected to each other, an air layer existing in each of the air holes 160 may induce an effect of cooling the surface of the flame hole member 100 to improve the durability of the burner.

Also, when a burning speed of the flame is greater than a spraying speed of the mixed gas that is sprayed through the surface of the flame hole member 100, a backfire in which combustion takes place inside the flame hole member 100 occurs, and such a backfire may occur when a size of the cell is excessively large.

Therefore, it may be preferable that an average size of a plurality of cells formed inside a unit volume of the flame hole member 100 is equal to or less than 1200 μm.

In this case, a size of a cell may be defined by Equation 1 as follows.

$$D=\sqrt{ab} \quad \text{[Equation 1]}$$

Here, D is the size of the cell, a is a major axis length of the cell, and b is a minor axis length thereof.

FIG. 7 is a diagram modeling a cell shape, and the cell shape has a shape of a dodecahedron, each surface of which is made of a regular pentagon. A cross section taken along line B-B at the middle of the dodecahedron becomes a regular pentagon, and this regular pentagon corresponds to a pentagonal shape that is defined as the cell in FIG. 6.

In this case, a for defining a size of each cell means a major axis length that is a longest diameter among diameters inside the pentagon defining each cell, and b means a minor axis length that is a shortest diameter among the diameters thereinside.

In actuality, the size of each cell of the flame hole member 100 is irregular so that the size thereof is defined by the value D that is obtained by geometrically averaging the major axis length a and the minor axis length b.

Meanwhile, because a load of the ventilator (not shown) is increased when a porosity is small, the porosity being an occupying ratio of pores per unit volume of the flame hole member 100, it may be preferable to make the porosity have equal to or greater than 80%. Here, the porosity is defined as an occupying radio of pores in a unit volume, which are an empty space except the struts 150 remaining in the unit volume.

Hereinafter, a surface shape of a flame hole member will be described with reference to FIGS. 8 to 12.

Figure 8:
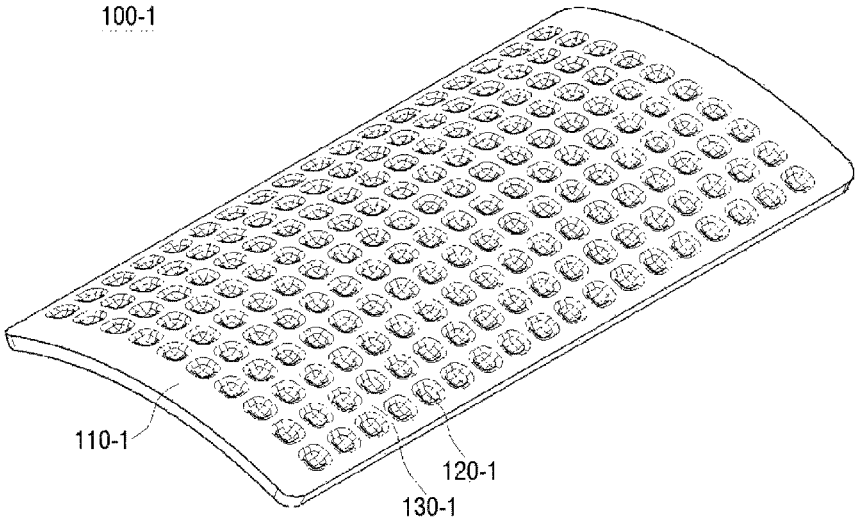
FIG. 8 is a perspective view of a flame hole member according to a first embodiment of the present disclosure.
Figure 9:
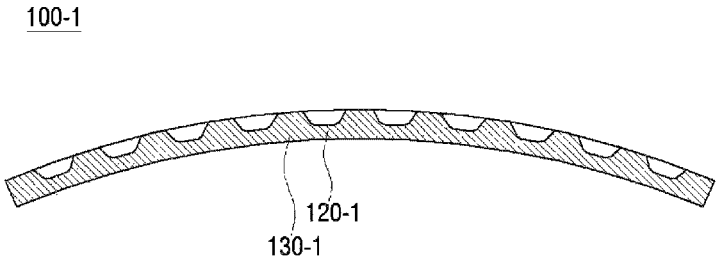
FIG. 9 is a cross-sectional view of the flame hole member shown in FIG. 8.

FIG. 8 is a perspective view of a flame hole member according to a first embodiment of the present disclosure, and FIG. 9 is a cross-sectional view of the flame hole member shown in FIG. 8.

A plurality of compressed portions 120-1, which are concavely pressed and compressed, are formed to be spaced apart from each other at a regular interval across an entire surface of a flame hole member 100-1 of the first embodiment.

The compressed portion 120-1 is formed to be thinner as compared to a thickness of a non-compressed portion 130-1, thereby having a large density so that a length of a flame is short on a surface of the compressed portion 120-1, whereas the thickness of the non-compressed portion 130-1 is greater to have a low density so that a length of a flame is long.

As described above, when the compressed portion 120-1 and the non-compressed portion 130-1 are formed to be adjacent to each other, even though a flame formed at the non-compressed portion 130-1 flies to cause a lifting phenomenon, a stable flame formed at the compressed portion 120-1 holds the flying flame of the non-compressed portion 130-1, thereby improving flame stability.

Figure 10:
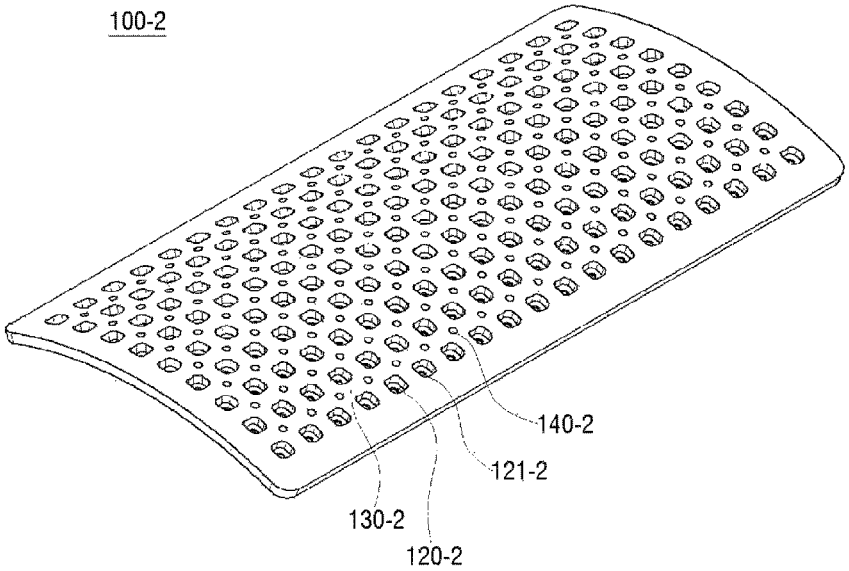
FIG. 10 is a perspective view of a flame hole member according to a second embodiment of the present disclosure.
Figure 11:
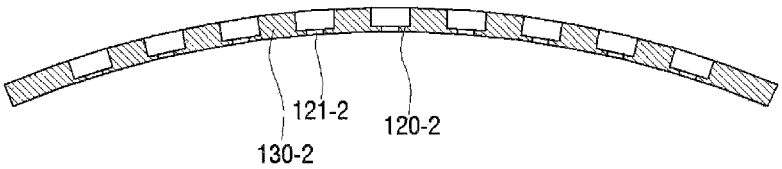
FIG. 11 is a cross-sectional view of the flame hole member shown in FIG. 10.

FIG. 10 is a perspective view of a flame hole member according to a second embodiment of the present disclosure, and FIG. 11 is a cross-sectional view of the flame hole member shown in FIG. 10.

A plurality of compressed portions 120-2, which are concavely pressed and compressed, are formed to be spaced apart from each other at a regular interval across an entire surface of a flame hole member 100-2 of the second embodiment.

A through hole 121-2 is formed to pass through a center of each of the compressed portions 120-2 in a thickness direction thereof, and a through hole 140-2 is formed to pass through between the compressed portions 120-2, which are adjacent to each other, in a thickness direction of a non-compressed portion 130-2 of the flame hole member 100-2.

As described above, the compressed portion 120-2 and the non-compressed portion 130-2 are arranged to be adjacent to each other so that the non-compressed portion 130-2 may prevent a lifting phenomenon of a flame, thereby improving flame stability.

Also, when a combustion load of a burner is high, there may occur a case in which only a spraying of the mixed gas through air holes of the flame hole member 100-2 is not sufficient. Therefore, as described above, the though hole 140-2 is formed between the through hole 121-2 inside each of the plurality of compressed portions 120-2 and a plurality of adjacent compressed portions 120-2 so that this may possible to respond to a high combustion load.

Figure 12:
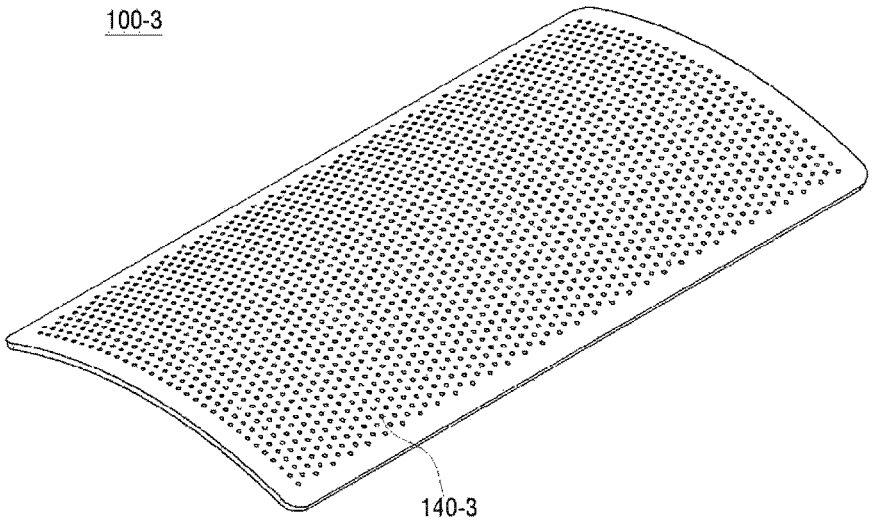
FIG. 12 is a perspective view of a flame hole member according to a third embodiment of the present disclosure.

FIG. 12 is a perspective view of a flame hole member according to a third embodiment of the present disclosure.

A plurality of through holes 140-3 are formed to be spaced apart from each other at a regular interval and to pass through in a thickness direction of a flame hole member 100-3 of the third embodiment across an entire surface thereof. Consequently, it may possible to respond to various combustion loads.

Figure 13:
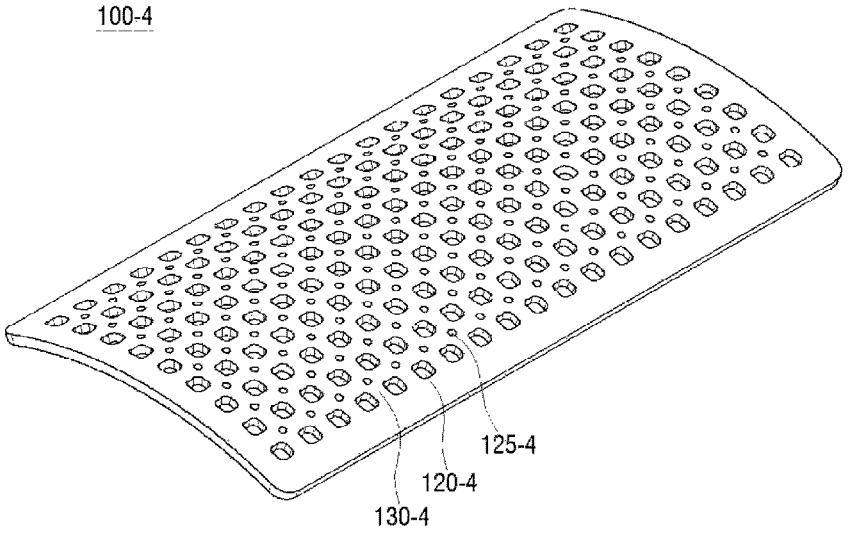
FIG. 13 is a perspective view of a flame hole member according to a fourth embodiment of the present disclosure.

FIG. 13 is a perspective view of a flame hole member according to a fourth embodiment of the present disclosure.

A compressed portion, which is formed at a flame hole member 100-4 of the fourth embodiment, is configured with a plurality of first compressed portions 120-4, each of which is concavely pressed in a predetermined depth from a surface of the flame hole member 100-4, and a plurality of second compressed portions 125-4, each of which is formed between the plurality of first compressed portions 120-4 and is smaller in size than the first compressed portion 120-4.

With such a configuration, a flame lifting from a non-compressed portion 130-4 may be stabilized by a flame formed by the compressed portion to improve flame stability, and sizes of the first compressed portion 120-4 and the second compressed portion 125-4 are different from each other so that it may be possible to respond to various combustion loads.

As described above, the present disclosure is not limited to the described embodiment, and it should be construed that modifications can be apparently devised by those skilled in the art without departing from the technical spirit of this disclosure defined by the appended claims, and also such modifications will fall within the scope of this disclosure.

DESCRIPTION OF REFERENCE NUMERALS

1: Burner
100, 100-1, 100-2, 100-3, and 100-4: Flame hole member
110: Edge
120-1, 120-2, 120-4, and 125-4: Compressed Portion
130-1, 130-2, and 130-4: Non-compressed Portion
150: Strut
160: Air Hole
200: Flame hole member Fixing Plate
210: Body Portion
220: Opening Portion
230: Coupling Portion
231: Flame hole member Coupling Portion
232: Distributing Plate Coupling Portion
300: Distributing Plate
310: Distributing Hole
320: Protrusion
330: Edge

What is claimed is:

1. A burner comprising:

a flame hole member made of a foam body which is made from a plurality of metal alloys through a sintering process and in which an air hole being a space between struts configuring a framework is formed, and configured to form a flame by allowing a mixed gas of gas and air to be sprayed through the air hole;

a flame hole member fixing plate configured to fixedly couple the flame hole member to a burner main body; and a distributing plate provided in front of the flame hole member and at which a plurality of distributing holes are formed so as to uniformly supply the mixed gas to the flame hole member, wherein the air hole is configured with multiple cells and multiple pores, each of the multiple cells being an inner space surrounded by the struts and each of the multiple pores being a space in which the cell is connected to a cell adjacent thereto, and an average size of the multiple cells being formed per unit volume of the flame hole member is equal to or less than 1200 μm.

2. The burner of claim 1, wherein a plurality of compressed portions are concavely pressed and compressed to be formed at a one side surface of the flame hole member and to be spaced apart from each other at a regular interval, the plurality of compressed portions are formed to be thinner as compared to a thickness of a non-compressed portion and are surrounded by the non-compressed portion.

3. The burner of claim 1, wherein a size of the cell is defined by the following Equation, $$D=\sqrt{ab} \quad \text{[Equation]}$$

wherein D represents the size of the cell, a represents a major axis length of the cell, and b represents a minor axis length thereof.

4. The burner of claim 1, wherein an occupying ratio of the air hole per unit volume of the flame hole member is equal to or greater than 80%.

5. The burner of claim 1, wherein a plurality of compressed portions are concavely pressed and compressed to be formed at a surface of the flame hole member and to be spaced apart from each other at a regular interval.

6. The burner of claim 5, wherein a through hole is formed inside each of the plurality of compressed portions to pass through in a thickness direction of the flame hole member.

7. The burner of claim 5, wherein a through hole is formed between the plurality of compressed portions to pass through in a thickness direction thereof.

8. The burner of claim 5, wherein the compressed portion is configured with multiple first compressed portions spaced apart from each other at a regular interval, and each of multiple second compressed portions formed between the multiple first compressed portions to have a size smaller than that of each of the multiple first compressed portions.

9. The burner of claim 1, wherein a plurality of through holes are formed at the flame hole member to pass therethrough in a thickness direction thereof and to be spaced apart from each other at a regular interval.

10. The burner of claim 1, wherein the distributing plate is coupled to the flame hole member fixing plate via the flame hole member interposed between the distributing plate and the flame hole member fixing plate.

11. The burner of claim 10, wherein a protrusion is formed at the distributing plate to be come into contact with a rear surface of the flame hole member, thereby separating the distributing plate from the rear surface of the flame hole member.

12. The burner of claim 11, wherein the protrusion is formed at an outer circumference of a region at which the plurality of distributing holes are formed.

13. The burner of claim 10, further comprising:

a gap plate configured to separate the distributing plate from the flame hole member, wherein the gap plate is formed to surround a region at which the distributing holes are formed.

14. The burner of claim 1, wherein the plurality of metal alloys include nickel (Ni), chrome (Cr), and aluminum (Al).

* * * * *